US008127888B1

(12) United States Patent
Mah

(10) Patent No.: US 8,127,888 B1
(45) Date of Patent: Mar. 6, 2012

(54) ENGINE SOUND DISTRIBUTION APPARATUS FOR A MOTOR VEHICLE

(75) Inventor: Keat Boon Mah, Portage, MI (US)

(73) Assignee: Mann + Hummel, GmbH, Ludwigsburg (DE)

( * ) Notice: Subject to any disclaimer, the term of this patent is extended or adjusted under 35 U.S.C. 154(b) by 0 days.

(21) Appl. No.: 13/019,423

(22) Filed: Feb. 2, 2011

(51) Int. Cl.
*G10K 11/22* (2006.01)

(52) U.S. Cl. ..... 181/271; 123/184.53

(58) Field of Classification Search ..... 181/271; 123/184.53, 184.54
See application file for complete search history.

(56) References Cited

U.S. PATENT DOCUMENTS

| | | | | |
|---|---|---|---|---|
| 6,848,410 | B2 * | 2/2005 | Hoffmann et al. | 123/184.57 |
| 7,353,791 | B2 * | 4/2008 | Sasaki et al. | 123/184.57 |
| 7,448,353 | B2 * | 11/2008 | Shinada et al. | 123/184.57 |
| 7,506,626 | B2 * | 3/2009 | Sasaki et al. | 123/184.53 |
| 7,717,230 | B2 * | 5/2010 | Takeuchi et al. | 181/271 |
| 7,845,466 | B2 * | 12/2010 | Kostun et al. | 181/271 |
| 2002/0157897 | A1 * | 10/2002 | Hofmann et al. | 181/214 |
| 2005/0121255 | A1 * | 6/2005 | Hofmann et al. | 181/250 |
| 2005/0133300 | A1 | 6/2005 | Hofmann et al. | |
| 2007/0079784 | A1 | 4/2007 | Sasaki et al. | |
| 2007/0131189 | A1 | 6/2007 | Shinada et al. | |
| 2007/0277768 | A1 * | 12/2007 | Takeuchi et al. | 123/184.57 |
| 2007/0295553 | A1 | 12/2007 | Ochi et al. | |
| 2009/0250290 | A1 * | 10/2009 | Jasnie et al. | 181/204 |

FOREIGN PATENT DOCUMENTS

| | | | |
|---|---|---|---|
| DE | 10016104 | A1 | 10/2001 |
| DE | 102007004774 | A1 | 8/2008 |
| JP | 2000045895 | A | 2/2000 |
| JP | 2000303925 | A | 10/2000 |

* cited by examiner

*Primary Examiner* — Jeremy Luks
(74) *Attorney, Agent, or Firm* — James Hasselbeck

(57) ABSTRACT

A sound distribution apparatus provides a driver with an audible impression of the operating speed, load and performance of a vehicle engine. The sound distribution apparatus includes an assembly of one or more sound transmission ducts interconnected to conduct or transmit engine sounds from the air intake tract into the passenger compartment and to distribute the sound in a uniform fashion from behind the dashboard at the front to the passenger compartment. The sound distribution duct includes a plurality of sound diffusion apertures arranged on the outer wall, each configured to diffuse a portion of the transmitted sound into the passenger compartment. A sound permeable airflow blockage device seals the sound transmission duct interior in a gas-tight way preventing airflow.

8 Claims, 1 Drawing Sheet

ENGINE SOUND DISTRIBUTION APPARATUS FOR A MOTOR VEHICLE

TECHNICAL FIELD

The invention relates to a device to transmit or conduct engine sounds from an intake system of an internal combustion engine into the interior of the motor vehicle and, more particularly, to a sound transmission and distribution apparatus providing a substantially uniform distribution of engine sound within the passenger compartment of a motor vehicle.

BACKGROUND OF THE INVENTION

Modern motor vehicles have internal combustion engines that are running very smoothly so that the operating noise can be hardly heard in the interior of the motor vehicle. The operating sound of the internal combustion engine may be obscured by secondary noises generated by the rolling noise of the wheels, traffic and road noises, fan noises from the vehicle air ventilation system, and the like. The sound insulation for vehicles has also improved to seal out unwanted noise for the occupants. Under certain circumstances it can be desirable to transmit the operating sounds of the internal combustion engine into the interior of the motor vehicle so as to provide the driver with an impression of how the engine in operating and provide an enhanced driving experience.

It is known to utilize a sound transmission tube or duct to conduct or channel sounds from the engine air intake tract toward the passenger compartment. In some cases the sound output of the sound transmission tube is relatively low in volume with the result that it is sometimes desirable to extend the sound transmission tube into the vehicle interior from the engine compartment to thereby improve the transmitted engine sound amplitude level for an improved driver experience.

It is known to provide a flexible diaphragm in the sound transmission tube to provide air flow isolation, thereby preventing air flow through the sound transmission tube. Even if the sound tube is not extended into the passenger compartment, it is undesirable to permit air flow back into the engine air intake tract through a sound transmission tube for which the purpose is strictly to conduct sound. This is especially undesirable if the sound tube is connected to the clean side of the air filter as any air flow through the tube would be introduced as unfiltered air into the air intake tract.

U.S. Pat. No. 7,658,263 discloses a device for noise transmission in a motor vehicle. In this device sound is transmitted along a transmission line having an enlarged mouth at one end and a diaphragm fitted to close off the mouth. A protective device is fitted at the end to protect the diaphragm.

U.S. 2006/0283658 A1 discloses a system for noise increase of an intake system of a motor vehicle. Various possibilities of noise introduction into the interior of the motor vehicle are illustrated wherein the diaphragm is arranged in a pipe conduit for noise transmission.

U.S. 2007/0079784 discloses two hollow sound transmission tubes in sound communication with an air intake tract. The tubes may be brought into the vehicle cabin interior.

JP2000045895A discloses an engine sound transmission system for introducing intake sound into the passage compartment.

However, these sound transmission devices radiate engine noise as a point source. There remains a need in the art for a sound transmission apparatus which evenly and broadly distributes engine sound in the passenger compartment.

SUMMARY OF THE INVENTION

A sound transmission and distribution apparatus to provide the driver and passengers with an audible impression of the operating speed, load and performance of a vehicle engine is disclosed. Advantageously, the apparatus transmits engine sounds from the engine compartment of the motor vehicle into the passenger compartment where it may be heard above background road noises and traffic noises.

The sound distribution apparatus includes an assembly of one or more sound transmission ducts interconnected to conduct or transmit engine sounds from the air intake tract into the passenger compartment and to distribute the sound in a uniform fashion from behind the dashboard at the front to the passenger compartment.

Motor vehicles may utilize soundproofing techniques to reduce the sound level of road noises as well as noises from other vehicles which may enter the passenger compartment. However, these techniques may also prevent motor vehicle occupants, particularly the driver, from experiencing an impression of the operating performance of the motor vehicle. The present invention provides a remedy to this situation by ensuring the driver, while benefiting from decreased road noise, is still provided with an audible impression of the vehicle engine speed, engine load and acceleration.

According to the invention, an apparatus to transmit and distribute engine sound in the passenger compartment of the motor vehicle includes a sound transmission duct having a first duct portion arranged in an engine compartment of the vehicle and in acoustic communication with an air intake tract of the engine. The sound transmission duct includes a second sound transmission duct portion which further includes a sound distribution duct arranged within the passenger compartment, preferably positioned behind the dashboard or console. The sound distribution duct outer wall includes a plurality of sound leakage apertures (also referred to herein as sound radiation or diffusion apertures) arranged on the outer wall of the sound distribution duct. The apertures are preferably spaced along a length of the sound distribution duct so that each aperture, working together, provides a widely diffused sound radiation into the vehicle interior. Each aperture is configured to transmit a portion of transmitted sound delivered by the sound transmission duct into the passenger compartment. To prevent air flow between the passenger compartment and the engine intake tract, the sound transmission and distribution apparatus includes a sound permeable air flow blockage device which is arranged in the sound transmission duct, preferably between the first and second duct portions, but may also be arranged at any location including in or at the sound distribution duct. The blockage device preferably provides a substantially gas-tight seal in the sound transmission duct while permitting sound to travel through the blockage device with only minor attenuation of the transmitted engine sound.

According to another aspect of the invention, the sound distribution duct is arranged across the front of the passenger compartment in a location behind the instrument panel (also referred to herein as the dashboard or console) of the motor vehicle. The sound distribution duct is tucked up under the console to hide it from the view of vehicle passengers.

According to another aspect of the invention, the sound permeable air flow blockage device utilizes a sound transmitting diaphragm which closes off the sound transmitting duct in a gas-tight way.

According to another aspect of the invention, the sound permeable air flow blockage device utilizes a sound transmitting foam member. The foam member closes off the interior of the sound transmission duct, substantially blocking air flow through the sound transmission duct while permeable to sound conducted through the sound transmission and distribution ducts.

According to another aspect of the invention, at least one end of the sound distribution duct in the passenger compartment is closed over by a wall impervious to air flow such that sound is diffused into the passenger compartment only through the apertures in the sound distribution duct.

According to another aspect of the invention, at least one end of the sound distribution duct is closed over by a sound transmitting diaphragm.

According to another aspect of the invention, at least one end of the sound distribution duct is closed over a sound permeable foam member.

BRIEF DESCRIPTION OF THE DRAWINGS

The accompanying Figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Features of the present invention, which are believed to be novel, are set forth in the drawings and more particularly in the appended claims. The invention, together with the further objects and advantages thereof, may be best understood with reference to the following description, taken in conjunction with the accompanying drawings. The drawings show a form of the invention that is presently preferred; however, the invention is not limited to the precise arrangement shown in the drawings.

Figure 1:
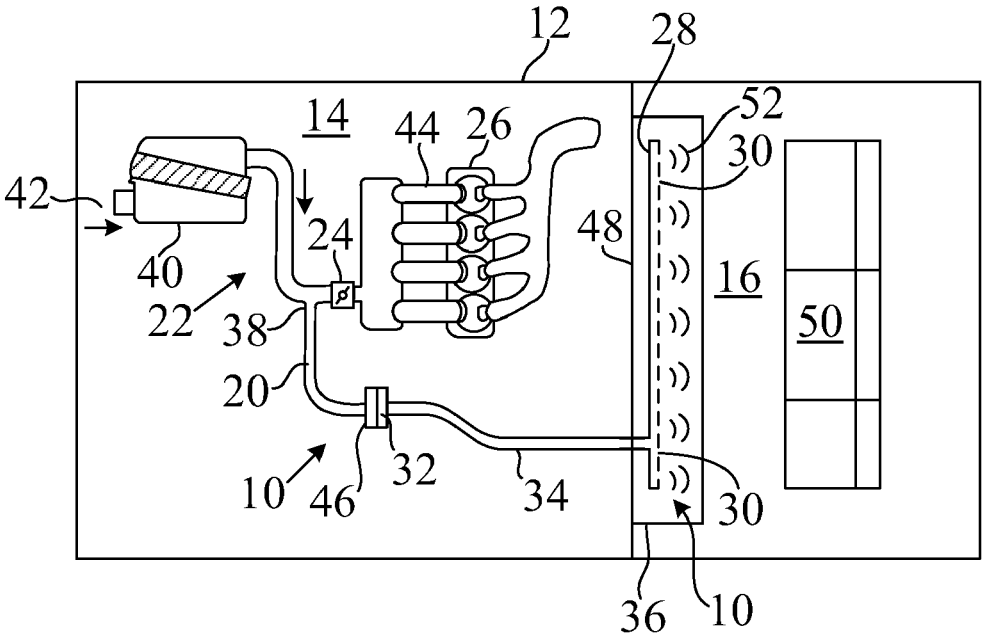
FIG. 1 presents a schematic plan view of an engine sound transmission and distribution apparatus installed in a motor vehicle, consistent with the present invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations of apparatus components related to an engine sound transmission and distribution apparatus for a motor vehicle. Accordingly, the apparatus components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises . . . a" does not, without more constraints, preclude the existence of additional identical elements in the process, method, article, or apparatus that comprises the element.

FIG. 1 presents a schematic plan view of an engine sound transmission and distribution apparatus installed in a motor vehicle. A sound transmission and distribution apparatus 10 is connected and arranged to transmit engine operating and engine performance sound. The sound distribution apparatus includes an assembly of one or more sound transmission ducts interconnected to conduct or transmit engine sounds from the air intake tract 22 into the passenger compartment 16.

Motor vehicles may utilize soundproofing techniques to reduce the sound level of road noises as well as noises from other vehicles which may enter the passenger compartment. However, these techniques may also prevent motor vehicle occupants, particularly the driver, from experiencing an impression of the operating performance of the motor vehicle. The present invention provides a remedy to this situation by ensuring the driver, while benefiting from decreased road noise, is still provided with an audible impression of the vehicle engine speed, engine load and acceleration.

According to the invention and the exemplary illustration of FIG. 1, the sound distribution apparatus includes a first duct portion 20 arranged in the engine compartment 14 of the motor vehicle 12 and having a first end 38 connected to and in acoustic communication with the air intake tract 22 of the internal combustion engine 26.

To capture engine operating sound for transmission to the passenger compartment, the first duct portion may be connected into the air intake tract 22 at any location between the fresh air intake 42 and the intake runners 44 of the internal combustion engine 26. A preferred connection location is between the air cleaner 40 and throttle body 24, as illustrated in FIG. 1.

A sound permeable air flow blockage device 46 is arranged in the sound distribution apparatus, positioned between and separating the sound conducting hollow interior of the first sound transmission duct portion 20 from the hollow interior of the second sound transmission duct portion 34. The sound permeable air flow blockage device is preferably realized as a flexible diaphragm 32 or membrane, providing a gas tight flexible wall sealing between the first and second duct portions, preventing air flow through the sound transmission duct 28 while permitting sound to propagate between the first and second duct portions.

In vehicle operation, the oscillating sound pressure in the air intake tract 22 is transmitted through the first portion 20 of the sound transmission duct and acts upon the air flow blockage device (example: the flexible membrane or diaphragm 32 that in turn is caused to vibrate according to sound pressure waves impacting the diaphragm.) The vibrations of the diaphragm conduct the sound pressure waves into the second duct portion of the sound transmission duct which extends towards the interior of the passenger compartment 16.

As the air intake tract 22 operates at a slight vacuum during engine operation, the gas-tight diaphragm 32 advantageously prevents the backflow of unfiltered air through the sound transmission duct (20 and 34) into the intake tract 22.

The diaphragm 32 may be installed in housing arranged in the sound transmission duct or between mating flanges, for example, mating flanges of the first 20 and second 34 duct portions of the sound transmission duct.

In an alternate embodiment, the sound permeable airflow blockage device may be realized as a sound permeable foam member rather than a diaphragm. The foam material may be selected to be acoustically permeable so that an excellent sound transmission is achieved while providing a barrier to air flow in the sound transmission duct. The foam member may be installed in a housing between the first and second duct portions, or clamped between mating flanges, or installed in any suitable way as would be known to those skilled in the art.

The material of the sound transmitting duct as well as that of the housing and flanges can be technical plastics. Suitable are in particular polyamide in non-reinforced or reinforced variants or polypropylene. However, other plastics or other materials are also conceivable.

Depending on the application, for obtaining the corresponding mechanical properties the diaphragm 32 can be made of rubber film, fabric or plastic film or can also be a metal foil or a thin sheet metal. It may also be a textile material, preferably gas tight material. In a preferred embodiment, the diaphragm 32 is comprised of a rubber material, for example, ethylene propylene diene rubber (EPDM), silicon rubber (VMQ), fluorosilicone rubber (FVMQ), fluoropolymer rubber (FPM or FKM) or other diaphragm materials that are employed in the field of internal combustion engines and known to a person skilled in the art.

The second duct portion 34 of the sound transmission duct extends through the firewall 48 into the interior of the passenger compartment 16, preferably concealed from view behind the driver's console or dashboard 36.

In the prior art, the sound tube, when it enters the passenger compartment, is realized as a closed wall tubular member having an open end through which sound is then radiated into the passenger compartment 16. While this is operable and effective, it has drawbacks. One issue is that the open end of the tubular member is a point source for sound. The engine sound point source may be readily perceived and easily located by the passengers as originating at a specific point location behind the dashboard of console 36, and therefore not perceived as directly delivered through the firewall. This imparts a sense of artificiality to the sound as though it's being generated through a speaker.

Advantageously, according to the present inventive disclosure, the second duct portion 34 of the sound transmission duct is a sound distribution duct 28 advantageously provided with a plurality of sound radiating apertures 30 spaced along the outer wall of the duct. The apertures 30 permit the transmitted engine sound to radiate (or leak out) into the passenger compartment in a diffused way along the length of the sound distribution duct. By arranging the sound distribution duct to extend behind the passenger compartment console 36, engine sounds may be radiated into the passenger compartment interior along at least a portion of the cross-vehicle length of the dashboard or console, thereby providing the vehicle passengers with a widely diffused engine sound source which is perceived as lying along the firewall directly in front of the passenger compartment and which rewards the vehicle occupants with an engine performance experience that is perceived as flooding into the vehicle interior across the front of the vehicle firewall. Due to the nature sound emitted through the apertures, there will be less resonance phenomena in the duct and therefore the engine sounds can be projected more linearly as the engine speed increases.

As shown schematically in FIG. 1, the sound radiating apertures 30 of the sound distribution duct 28 may be preferably arranged to direct the transmitted engine sound 52 in the general direction of the passengers (in the general direction of schematically illustrated passenger bench seat 50). This may be achieved, for example, by providing the sound radiating apertures 30 along one or two quadrants (one half) of the outer circumference of the wall of the sound distribution duct 28. The apertures may be arranged to direct engine sound into the passenger compartment and possibly somewhat downwardly to enter the air space of the passenger compartment at a location below the console 36. Sometimes it may be desirable to have the sound reflected off other surfaces in the cabin interior in order to have a more reverberant sound. Due to the flexibility of the arrangement of the apertures, the interior sound can be tailored or finely tuned to the desired sound quality without major tooling changes.

In some embodiments, the sound radiating apertures 30 may be the only openings provided in the sound distribution duct 28 through which sound may radiate into the interior (more specifically, the one or more ends of the sound distribution duct 28 may be closed over).

In other embodiments, the sound distribution duct 28 may have one or more open axial ends providing additional openings through which engine sound may radiate into the vehicle interior.

In additional embodiments, the sound distribution duct 28 may connect at one or more of its ends into the air circulation vents or ducts in the vehicle passenger compartment. In this way engine operating sound may also be conducted through the air circulation ducts. However, the preferred embodiment is the lengthwise diffuse sound distribution of multiple apertures in the sound distribution duct arranged behind the dashboard, as schematically illustrated in FIGS. 1 and 2.

Figure 2:
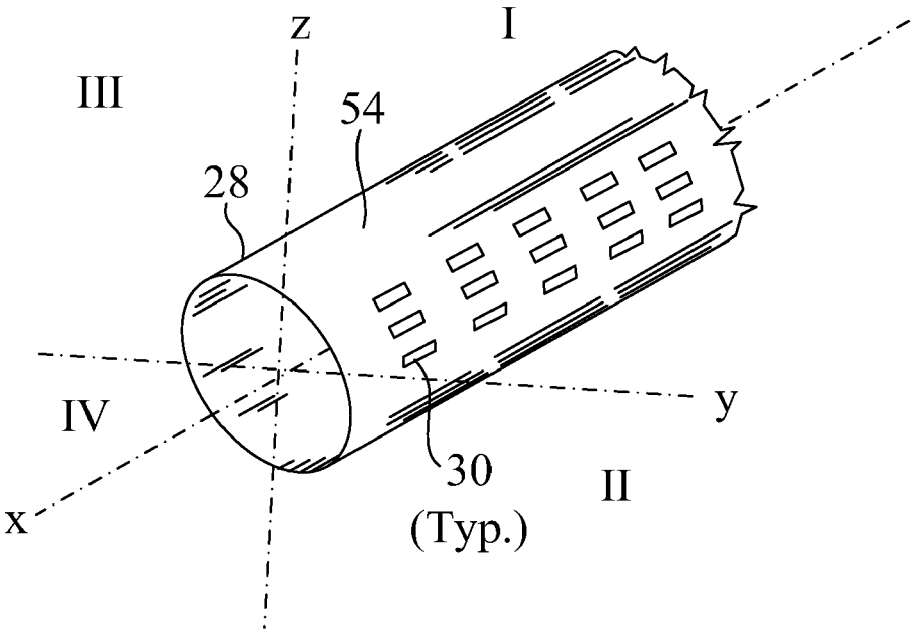
FIG. 2 depicts a portion of a sound distribution duct having directed sound radiating apertures, consistent with the present invention.

In FIG. 2 the sound radiating apertures 30 are shown as slots arranged in axial rows over a portion of the first quadrant "I" (upper right quadrant between axis y and z) of the outer wall 54 of the sound distribution duct 28. The apertures may be provided as slits or other opening in the wall which render the wall porous to the radiation of sound energy. In preferred embodiments, the apertures 30 may be arranged on the outer wall 54 substantially over a circumferential range of two quadrants (example: quadrants "I" and "II"), with the apertures in these quadrants positioned to direct sound energy into the vehicle passenger compartment 16 and possibly slanted towards the passenger compartment floor so as to direct sound energy directly into the passenger compartment interior.

In other embodiments, the apertures 30 may be arranged in any number of quadrants or completely circumscribing the outer wall 54 of the sound distribution duct 28.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of the present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

The invention claimed is:

1. A sound distribution apparatus transmitting engine sounds into a passenger compartment of a motor vehicle, comprising:

a sound transmission duct arranged in an engine compartment of said vehicle, said sound transmission duct having a first end in acoustic communication with an air intake tract of said engine and a second end extending through a firewall into an interior of said passenger compartment;

an elongated sound distribution duct having a length, said sound distribution duct arranged entirely within said passenger compartment, said elongated sound distribution duct connected to and in acoustic communication with a second end of said sound transmission duct, said sound distribution duct having a circumscribing outer wall and a hollow interior, said outer wall including a plurality of sound diffusion apertures arranged on and extending through said outer wall, said sound diffusion apertures spaced apart along said length of said sound distribution duct outer wall, said sound diffusion apertures opening directly into an interior of said passenger compartment, said apertures transmitting a portion of transmitted sound from said hollow interior into said passenger compartment;

a sound permeable air flow blockage device closing off an interior of said sound distribution apparatus in a substantially gas-tight way while permitting sound to be conducted through said blockage device.

2. The apparatus according to claim 1 wherein at least said sound distribution duct is arranged behind an instrument panel of said vehicle, said sound distribution duct positioned out of view of passengers and having a length extending across at least a portion of a length of said instrument panel.

3. The apparatus according to claim 1 wherein, said sound permeable air flow blockage device comprises a sound transmitting diaphragm.

4. The apparatus according to claim 1, wherein, said sound permeable air flow blockage device comprises a sound transmitting foam member, said foam member substantially blocking air flow through said sound transmission duct while permitting sound to pass through said blockage device.

5. The apparatus according to claim 2, wherein said sound transmission duct comprises a first sound transmission duct portion acoustically coupled to a second sound transmission duct portion, wherein said sound permeable air flow blockage device is arranged in said sound transmission duct between and connecting a second end of said first duct portion and a first end of said second duct portion, said blockage device separating a hollow interior of said first duct portion from the hollow interior of said second duct portion while transmitting sound between said first and second duct portions.

6. The apparatus according to claim 2, wherein, at least one end of said sound distribution duct is closed over by a wall impervious to air flow.

7. The apparatus according to claim 2, wherein at least one end of said sound distribution duct is closed over a sound transmitting diaphragm.

8. The apparatus according to claim 2, wherein at least one of said axial ends of said sound distribution duct terminates in and opens into said interior of said passenger compartment, wherein said at least one end of said sound distribution duct is closed over by a sound permeable foam member.

* * * * *